US006260253B1

(12) United States Patent
Kimzey

(10) Patent No.: US 6,260,253 B1
(45) Date of Patent: Jul. 17, 2001

(54) BROKEN KEY EXTRACTOR

(76) Inventor: Douglas L. Kimzey, 1238 111 Ave. NE., Bellevue, WA (US) 98004

( * ) Notice: Subject to any disclaimer, the term of this patent is extended or adjusted under 35 U.S.C. 154(b) by 0 days.

(21) Appl. No.: 09/528,808

(22) Filed: Mar. 20, 2000

Related U.S. Application Data

(62) Division of application No. 09/253,935, filed on Feb. 22, 1999, now Pat. No. 6,052,883.

(51) Int. Cl.[7] ..... B25B 27/00
(52) U.S. Cl. ..... 29/426.5; 29/270; 29/278
(58) Field of Search ..... 29/270, 240, 240.5, 29/264, 278, 426.5; 433/102, 224

(56) References Cited

U.S. PATENT DOCUMENTS 5,938,440 8/1999 McSpadden .
5,967,778 10/1999 Riitano .

*Primary Examiner*—Robert C. Watson
(74) *Attorney, Agent, or Firm*—Young & Basile, P.C.

(57) ABSTRACT

An extractor for removing inaccessible broken key portions from keyways of tumbler locks wherein the extractor tool consists of a pair of thin elongated elements capable of being inserted into the lock on opposite sides of the broken key end portion and wherein twisting of the elements grips the broken key end to permit extraction from the lock. Extraction is aided by a pliers-like spreader tool having thin jaws inserted into the lock keyway for retracting lock tumblers, the dust shutter door and buzzer electric switches to prevent such items from interfering with the key extraction.

7 Claims, 2 Drawing Sheets

BROKEN KEY EXTRACTOR

This is a division of application Ser. No. 09/253,935 filed Feb. 22,1999, now U.S. Pat. No. 6,052,883.

BACKGROUND OF THE INVENTION

1. Field of the Invention

The invention pertains to tools for extracting inaccessible broken key ends from lock keyways, particularly automobile ignition locks, without damage or modification to the lock structure.

2. Description of the Related Art

It is not uncommon for the end portion of a key to break off in a lock keyway, particularly an automobile ignition lock utilizing tumblers. Such automobile locks usually constitute the primary electrical switch for the vehicle and employ the key to impose a torque on the switch once the key is properly inserted, and keys are often bent or otherwise stressed due to the forces imposed thereon during use.

When a portion of the automobile ignition key is broken off within the lock keyway or slot, such broken end is usually inaccessible, often prevents the ignition switch from being operated and renders the vehicle inoperative. Until the inaccessible broken key end portion is removed from the lock, operation of the vehicle is usually prevented.

Broken key extractors are known and such devices may use a variety of tools for endeavoring to coax the broken key end from the lock. Adhesives, hook probes, and the like, may be used. However, the difficulty encountered in removing broken keys from tumbler locks often is so great that the lock must be entirely replaced at considerable expense.

As of this date, easy to use, dependable apparatus for removing broken key portions from tumbler locks has not been available to the general public.

OBJECTS OF THE INVENTION

It is an object of the invention to provide an extractor for removing broken keys from tumbler locks wherein the extractor tool is of a low cost, dependable, easy to use and relatively quick and may be operated by those having conventional mechanical skills.

Another object of the invention is to provide an extractor tool for removing broken key portions from tumbler locks wherein the extractor tool does no damage to the lock and its associated mechanism and permits the lock to be operated in the normal manner after key extraction.

Yet another object of the invention is to provide a method of extracting an inaccessible broken key portion from a tumbler lock keyway which can be practiced by persons of ordinary mechanical skill.

SUMMARY OF THE INVENTION

In the practice of the invention, a pair of thin deformable elongated retractor elements are inserted into a tumbler lock keyway or slot in such a manner as to grip an inaccessible key end located within the lock. Preferably, the practice of the method of the invention utilizes the accessible portion of the broken key, or a similar key blank, to be used as a guide for inserting the retraction elements into the lock, and into the grooves defined in the sides of the inaccessible broken key end. Once the accessible key portion is used to guide the extractor elements into the desired position, the accessible key portion is then removed from the lock. Thereupon, the retractor elements are twisted about each other causing the elements to twist within the lock and those portions of the retractor elements engaging the inaccessible key end portion within the lock tightly grip the broken key end permitting the same to be pulled from the keyway.

To aid in the retraction of the inaccessible key end after the retractor elements are twisted, a spreader tool of a plier type having thin jaws receivable within the keyway is used to hold tumblers, dust covers, electric switches, and other obstructions, located within the lock out of the lock keyway as the inaccessible broken key end is pulled from the lock. In this manner, the broken inaccessible key end can be pulled from the lock opening without damage to the lock.

In order to improve the gripping of the inaccessible key end portion by the retractor elements, the retractor elements are provided with friction enhancing means in the form of a tooth spirally formed on the elements throughout the elements' blade length whereby the twisting of the elements causes the elements' tooth to firmly grip and partially imbed into the broken key end to increase the frictional connection between the retraction elements and the broken key end permitting the key end to be pulled from the lock.

The retractor elements and spreader can be economically manufactured by conventional fabricating techniques, and the practice of the method of the invention, and the apparatus thereof, are relatively simple and practiceable by users of ordinary mechanical skill.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
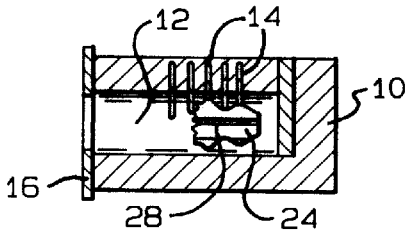
FIG. 1 is a sectional elevational view of a tumbler lock illustrating an inaccessible broken key end portion therein.

A lock 10 of the general type with which the inventive concept may be practiced is shown in the drawings in a somewhat schematic manner, and may represent a typical vehicle ignition lock. The lock includes a keyway 12 into which the key is inserted, and the lock keyway 12 usually includes a plurality of tumblers 14 which will engage the key when inserted into the lock keyway 12 to produce the proper alignment to permit the lock to be rotated. The lock includes a portion 16 which may constitute a keyway entrance and a dust shutter and dust shutter mechanism of the spring biased type may be affixed thereto. Also, modern locks often include identification switches or key buzzer switches adjacent the lock keyway entrance, and such apparatus, not shown, will normally be located in the keyway adjacent the dust shutter opening portion 16.

A conventional key, generally indicated at 18, is adapted to be inserted into the lock keyway 12 to properly position the tumblers 14 so that the lock 10 may be rotated to operate a vehicle starter switch, accessory switch, or the like. In the practice of the invention, the key 18 has broken at 19 and includes an accessible key portion 20 which is exterior of the lock 10 and may be manually withdrawn from the lock keyway 12 by means of the key handle 22 affixed to the accessible portion. The inaccessible broken key portion 24, FIGS. 1–3, remains within the lock in engagement with tumblers 14, and as the portion 24 is usually located well within the lock keyway past the dust shutter 16, the key portion 24 is not readily accessible. Usually, longitudinally extending grooves are defined in the key 18 along the opposite sides thereof, and in the drawings, these grooves 26 are those within the accessible key portion 20, and the key grooves 28 are those defined in the broken inaccessible key portion 24.

Figure 9:
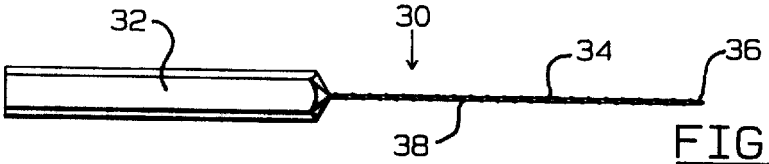
FIG. 9 is an elevational side view of a single retraction element.
Figure 10:
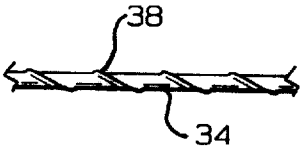
FIG. 10 is an elevational detail view of the teeth formed on an extraction element blade.

To remove the key portion 24 from the lock keyway 12, a pair of identical extraction elements 30 are employed. In FIG. 9, an element 30 is shown which consists of a handle 32, which may be of a synthetic plastic material, and a thin elongated blade 34 having an outer pointed end 36. While the handle 32 may be formed of a synthetic plastic, the blade 34 is made of metal, usually a steel of a relatively hard composition, but soft enough as to be deformable and twisted without fracturing.

Figure 11:
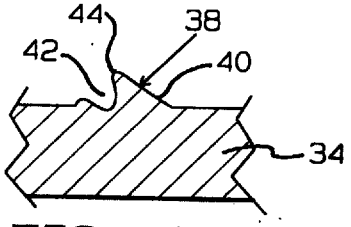
FIG. 11 is an enlarged diametrical elevational sectional view of a retraction element blade illustrating the configuration of the spiral tooth defined thereon.

Preferably, the blade 34, which is basically of a cylindrical configuration, includes a friction enhancing tooth 38 defined thereon. The tooth 38 is preferably formed in a spiral manner as to exist throughout the circumference and length of the associated blade 34 forming, in effect, a plurality of teeth including a sharp apex as will appreciated from the enlarged detail sectional view of FIG. 11. The teeth 38 may be rolled from the material of the blade 34 or machined into the blade, and preferably are of a shape such as is apparent in FIG. 11 wherein the spiral tooth 38 includes a slope 40, and the rolling or machining process produces a recess 42. The resultant tooth includes a sharpened apex 44 which slants toward the associated handle 32, i.e. to the left with reference to FIG. 11.

Figure 7:
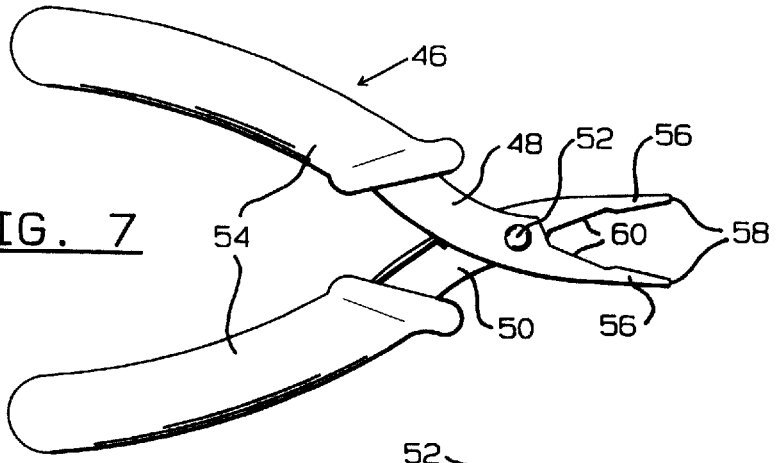
FIG. 7 is a side elevational view of the pliers type spreader tool used in accord with the invention.
Figure 8:
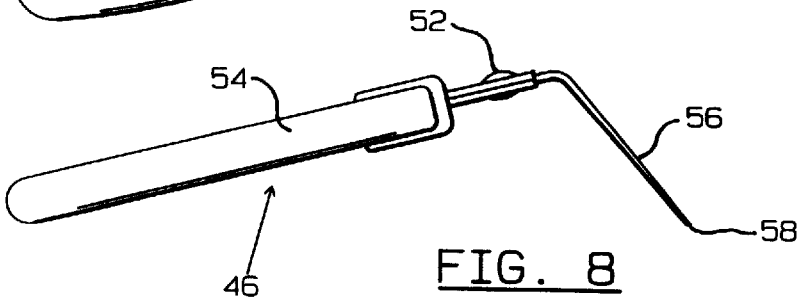
FIG. 8 is a top plan view of the spreader tool of FIG. 7.

Extraction of the key portion 24 from the lock keyway 12 is usually facilitated by the use of the spreader tool 46 shown in FIGS. 7 and 8. This spreader tool is of a plier type consisting of levers 48 and 50 pivotably interconnected at 52, each lever having a handle portion 54 at one end and thin elongated jaw 56 at the other end. Each of the jaws 56 terminates in a relative sharp point 58. On the inside surface of each jaw 56, a recess 60 is defined to provide clearance for the extraction elements as later described. As will be noted in FIG. 8, the jaws 56 lie in a plane oblique to the plane of the handles 54.

Figure 2:
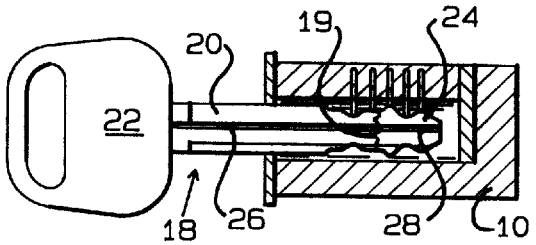
FIG. 2 is an elevational sectional view similar to FIG. 1 illustrating the insertion of the accessible key end into the lock keyway.
Figure 3:
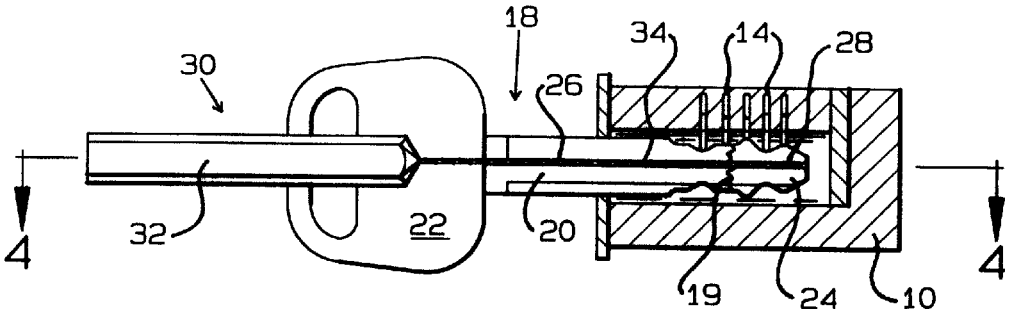
FIG. 3 is an elevational sectional view similar to FIG. 2 illustrating the insertion of the extractor elements into the lock keyway using the grooves defined in the accessible and inaccessible key portions as guides.

The use of the broken inaccessible key portion extraction tools will now be described:

As illustrated in FIG. 1, when the key breaks off within the lock keyway 12, the key portion 24 will usually be engaging tumblers 14 which will hold the inaccessible key portion 24 within the keyway 12, and usually, the key portion 24 is well within the lock keyway 12 as to be inaccessible and not be visible. To extract the inaccessible key portion 24 from the lock keyway 12, the broken accessible key portion 20 is inserted into the keyway 12 as shown in FIGS. 2 and 3. The key portion 20 is inserted into the lock keyway 12 until the key portion 24 is engaged at the broken edge 19 as shown in FIGS. 2 and 3. If the accessible key portion 20 is not available, having been misplaced or lost, and in such instance, the invention may be practiced by inserting a key blank into the lock opening which has grooves 26 matching those defined in the lock opening and key portion 24.

Figure 4:
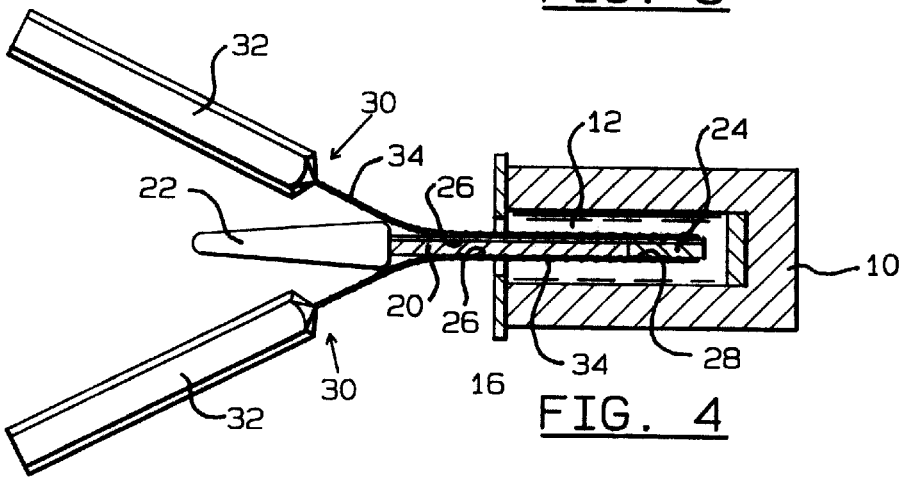
FIG. 4 is a plan sectional view of FIG. 3 taken along Section 4—4 thereof.

Once the accessible key portion 20, or blank is inserted into the lock keyway 12 as shown in FIG. 2, the two extraction elements 30 are aligned with the key grooves 26 of the key portion 20 and the blade outer ends 36 inserted into the grooves 26 on both sides of key portions 20. This insertion of the blades 34 into the grooves 26 is readily accomplished in view of the flexible character of the blades 34 and the sharp points of the blades, and the loose fit of the key in the keyway, and the blades 34 are fully inserted into the lock keyway 12 as far as possible. Because the key grooves 26 of the accessible key portion 20 will be in alignment with the key grooves 28 of the inaccessible key portion 24, the insertion of the extractor element blades 34 into the grooves 26 will also guide the blades into the key grooves 28 as shown in FIGS. 3 and 4.

Figure 5:
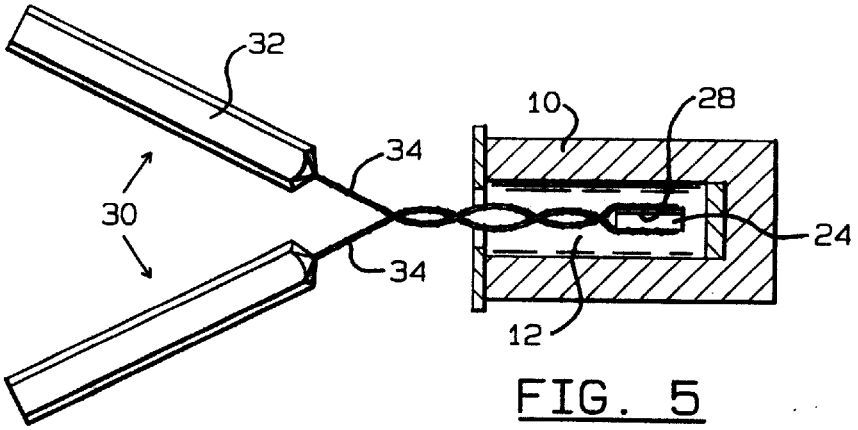
FIG. 5 is a plan sectional view similar to FIG. 4 upon the accessible key portion being withdrawn from the lock keyway, and the retraction elements being twisted to grip the broken inaccessible key end.
Figure 6:
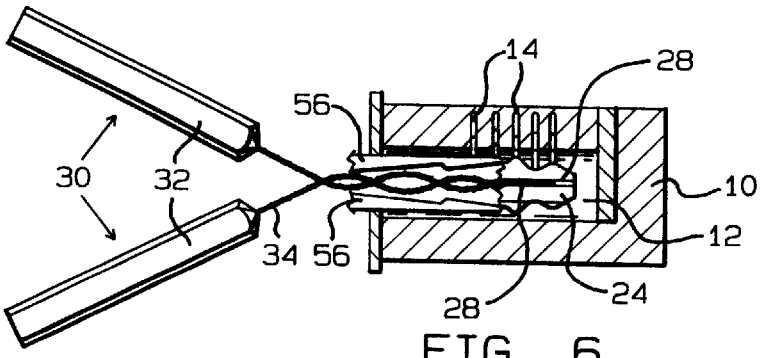
FIG. 6 is a side elevational view of the components of FIG. 5 with the spreader tool jaws in place.

Once the extraction element blades 34 are fully inserted into the lock keyway 12 as to be located upon opposite sides of the key portion 24 within the grooves 28 thereof, the accessible key portion 20 is carefully removed from the lock opening 12 while the extraction elements 30 are maintained within the lock in engagement with the key portion 24. Once the key portion 20 is removed, the extraction elements are twisted by handles 32 wherein the blades 34 thereof will twist about each other as shown in FIGS. 5 and 6. The physical characteristics of the metal of the blades 34 permits such twisting without breaking the blades 34 and such twisting will occur so that several full turns are made. The result of the twisting of the blades 34 as shown in FIGS. 5 and 6 is to cause the blade portions in engagement with the inaccessible key portion 24 to tightly grip the key portion 24 due to the forces imposed upon the blades 34 during twisting. As the blades 34 are forced into a squeezing or gripping relationship with the key portion 24, the apex 44 of the tooth 38 will tightly grip, and slightly imbed, into the material of the key portion 24 adjacent the associated grooves 28 permitting the key portion 24 to be tightly held by the extraction elements 30.

At this point, in rare cases, it is possible to extract the key portion 24 from the lock keyway 12 by pulling the extraction elements 30 from the lock keyway 12 by means of the extraction element handles 32. In most instances, the friction produced by the tumblers 14, which may be of the wafer type, may prevent such extraction of the key portion 24 from the lock and a pick could be used to retract the tumblers, however, because of multiple obstructions, preferably, the spreader tool 46 is used prior to attempting to withdraw the key portion from the lock keyway after the blades 34 have been intertwisted.

The jaws 56 of the tool 46 are thin enough as to be received within the lock keyway 12 with the jaws being located within the plane of the key portion 24. Accordingly, the jaws 56, when moved toward each other by the application of force to the handles 54, can be inserted into the lock keyway 12 to a depth equal to the key portion 24, FIG. 6. Thereupon, the tool jaws 56 are "opened" by spring action which permits the jaws 56 to engage the tumblers 14 between the key portion 24 and the dust shutter 16 and push the tumblers 14 out of the keyway 12, and further, the jaws 56 are effective to maintain the dust shutter in an open condition, and retract any electrical switch actuator or other apparatus which may exist within the lock keyway 12. The recesses 60 defined in the jaws 56 provide clearance for the twisted blades 34 to extend through the jaws 56. The jaws 56 and the extractor elements 30 and key portion 24 are then simultaneously slowly pulled from lock keyway 12 which permits the key portion 24 to be withdrawn from the lock keyway 12 while the jaws 56 remain open holding all obstructions out of the keyway as the key portion 24 is withdrawn from the lock keyway. As will be appreciated from FIG. 8, the angular offset configuration of the spreader tool jaws 56 aids in the above described manipulation of the spreader tool 46 and the extraction elements 30.

From the above description, it will be appreciated that the extraction elements 30 and the spreader tool 46 permit inaccessible key portions to be quickly withdrawn from a lock keyway without damage or harm to the lock structure. The extraction elements 30 and spreader tool 46 may be economically manufactured, and the cost of these tools is well below the cost, labor and time involved, in replacing a lock having a broken key portion therein.

It is appreciated that various modifications to the inventive concepts may be apparent to those skilled in the art without departing from the spirit and scope of the invention.

What is claimed is:

1. The method of extracting an elongated inaccessible broken key from a lock keyway wherein the broken key includes accessible and inaccessible ends and includes opposite sides comprising the steps of:

(a) inserting the accessible key end into the lock keyway until it substantially engages the key inaccessible end, (b) using the accessible key end as a guide, inserting a pair of thin elongated extractors in the lock keyway, an extractor being located adjacent each side of the accessible key end and inserted to a depth such that the extractors are located at the opposite sides of the inaccessible key end, (c) removing the accessible key end from the lock keyway while maintaining the extractors within the lock keyway at opposite sides of the inaccessible key end, (d) twisting the extractors together while in the lock keyway to cause the extractors to frictionally grip the inaccessible key end, and (e) withdrawing the twisted extractors and inaccessible key end from the lock keyway.

2. The method of extracting an elongated inaccessible broken key from a lock opening as in claim 1 wherein the extractors include friction enhancing means for increasing the frictional grip of the extractors upon the inaccessible key end.

3. The method of extracting an elongated inaccessible broken key from a lock keyway as in claim 2 wherein the friction enhancing means comprise teeth formed on the extractors.

4. The method of extracting an elongated inaccessible broken key from a lock keyway as in claim 1, the lock keyway including tumblers, including the step of retracting the tumblers during the withdrawing of the twisted extractors and inaccessible key end from the lock opening.

5. The method of extracting an elongated inaccessible broken key from a lock opening as in claim 1, the lock keyway including tumblers, including the steps of inserting a tumbler retracting tool into the lock keyway after twisting the extractors together, and retracting the lock keyway tumblers with the retracting tool during the withdrawing of the twisted extractors and inaccessible key end from the lock keyway.

6. The method of extracting an elongated inaccessible broken key from a lock keyway having tumblers wherein the broken key includes accessible and inaccessible ends and includes opposite sides and at least one of the sides includes a longitudinally extending groove comprising the steps of:

(a) inserting the accessible key end into the lock keyway until it substantially engages the key inaccessible end, (b) using the accessible key end groove as a guide, inserting a pair of thin elongated extractors in the lock keyway, an extractor being located adjacent each side of the accessible key end and inserted to a depth such that the extractors are located at the opposite sides of the inaccessible key end, (c) removing the accessible key end from the lock keyway while maintaining the extractors within the lock keyway at opposite sides of the inaccessible key end, (d) twisting the extractors together while in the lock keyway to cause the extractors to frictionally grip the inaccessible key end, and (e) withdrawing the twisted extractors and inaccessible key end from the lock keyway.

7. The method of extracting an elongated inaccessible broken key from a lock keyway as in claim 6 wherein a groove is defined in each opposite side of the key accessible and inaccessible ends, an extractor being located in each groove.

* * * * *